US010975550B2

(12) United States Patent
Ito et al.

(10) Patent No.: US 10,975,550 B2
(45) Date of Patent: Apr. 13, 2021

(54) VIBRATION SUPPRESSION CONTROL CIRCUIT

(71) Applicant: KAWASAKI JUKOGYO KABUSHIKI KAISHA, Kobe (JP)

(72) Inventors: Makoto Ito, Kobe (JP); Syunichi Sakamoto, Kakogawa (JP); Takahiro Okazaki, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/608,928

(22) PCT Filed: Apr. 27, 2018

(86) PCT No.: PCT/JP2018/017248
§ 371 (c)(1),
(2) Date: Oct. 28, 2019

(87) PCT Pub. No.: WO2018/199301
PCT Pub. Date: Nov. 1, 2018

(65) Prior Publication Data

US 2020/0263392 A1 Aug. 20, 2020

(30) Foreign Application Priority Data

Apr. 27, 2017 (JP) ..... JP2017-087842

(51) Int. Cl.
*E02F 9/22* (2006.01)
*F15B 11/02* (2006.01)

(52) U.S. Cl.
CPC ..... *E02F 9/2207* (2013.01); *E02F 9/2217* (2013.01); *E02F 9/2221* (2013.01); *E02F 9/2267* (2013.01);
(Continued)

(58) Field of Classification Search
CPC ..... E02F 9/2207; E02F 9/2217; F15B 21/14; F15B 21/008; F15B 2211/8613; F15B 2211/8616
See application file for complete search history.

(56) References Cited

U.S. PATENT DOCUMENTS 5,733,095 A * 3/1998 Palmer ..... E02F 9/2207 414/685
6,634,653 B2 * 10/2003 Chatterjea ..... B60G 17/056 280/5.5
(Continued)

FOREIGN PATENT DOCUMENTS

JP H10-140617 A 5/1998
JP 2006045851 A * 2/2006 ..... E02F 9/2217
JP 4456078 B2 4/2010

OTHER PUBLICATIONS

JP 2006045851 A machine translation to English from espacenet (Year: 2006).*

*Primary Examiner* — Michael Leslie
*Assistant Examiner* — Michael Quandt
(74) *Attorney, Agent, or Firm* — Oliff PLC

(57) ABSTRACT

In a vibration suppression control OFF state, a signal pressure supply control valve stops supplying a first signal pressure, a pressure-regulating valve is in first position where a supply/discharge port connects to a pump port, and an open/close signal pressure is not supplied to an open/close control valve, so an open/close valve is closed. When the OFF state switches to ON state, the signal pressure supply control valve allows supplying the first signal pressure, and the pressure-regulating valve is in second position where the supply/discharge port connects to a tank port, so the pressure of a pressure accumulator decreases. In the ON state, when the pressure of the pressure accumulator is equal to pressure of a pressure chamber, the pressure-regulating
(Continued)

valve is in third position where the supply/discharge port is blocked, and the open/close signal pressure is supplied to the open/close control valve, so the open/close valve is opened.

4 Claims, 4 Drawing Sheets

(52) U.S. Cl.
CPC ..... *F15B 11/02* (2013.01); *F15B 2211/329* (2013.01); *F15B 2211/625* (2013.01); *F15B 2211/7053* (2013.01); *F15B 2211/8613* (2013.01)

(56) References Cited

U.S. PATENT DOCUMENTS 7,621,124 B2 * 11/2009 Mizoguchi ..... E02F 9/2217 60/469
2007/0056277 A1 3/2007 Mizoguchi et al.

* cited by examiner

VIBRATION SUPPRESSION CONTROL CIRCUIT

TECHNICAL FIELD

The present invention relates to a vibration suppression control circuit installed in a work vehicle, such a wheel loader.

BACKGROUND ART

While a work vehicle is running, if a work apparatus of the work vehicle vibrates, it also causes vibration to the vehicle body and the operator's seat. In light of this problem, some of the work vehicles are equipped with a running vibration suppressing device. While such a work vehicle equipped with the running vibration suppressing device is running, the running vibration suppressing device allows the pressure chamber of an actuator that moves the work apparatus to communicate with a pressure accumulator (see Patent Literature 1, for example). As a result of the pressure chamber communicating with the pressure accumulator, pressure pulsation of the pressure chamber can be absorbed by the pressure accumulator. In this manner, vibration of the work apparatus can be suppressed, and consequently, vibration of the vehicle body can be suppressed, thereby improving the comfortableness of the ride.

The running vibration suppressing device is provided with pressure sensors that detect the load pressure of the actuator and the pressure of the pressure accumulator. Based on the detected two pressures, a controller controls a ride control valve that controls whether or not to allow the communication between the pressure accumulator and the pressure chamber. If the pressure of the pressure accumulator is higher than the load pressure, the controller controls the ride control valve to: lower the pressure of the pressure accumulator to the load pressure; and then allow the pressure accumulator to communicate with the pressure chamber.

CITATION LIST

Patent Literature

PTL 1: Japanese Patent No. 4456078

SUMMARY OF INVENTION

Technical Problem

However, the above-described running vibration suppressing device requires a plurality of pressure sensors, and also requires construction and implementation of a control routine that is executed by referring to the pressures detected by the pressure sensors. For these reasons, both hardware and software configurations of the running vibration suppressing device are complex.

An object of the present invention is to provide a vibration suppression control circuit that is intended for a work vehicle and that can be simplified in configuration.

Solution to Problem

A vibration suppression control circuit according to one aspect of the present invention is a vibration suppression control circuit installed in a work machine, the work machine including an actuator configured to move a work apparatus mounted to a vehicle body of the work machine in accordance with supply and discharge of pressure oil to and from a pressure chamber of the actuator, the vibration suppression control circuit being switchable between a vibration suppression control OFF state and a vibration suppression control ON state while the work machine is running. The vibration suppression control circuit includes: a pressure accumulator; a pressure-regulating valve including, a supply/discharge port connected to the pressure accumulator via a supply/discharge line, a pump port, a tank port, a first signal chamber to which a pressure of the pressure accumulator is led as a first signal pressure, and a second signal chamber to which a pressure of the pressure chamber is led as a second signal pressure; a signal pressure supply control valve configured to control whether or not to allow supplying the first signal pressure to the first signal chamber; an open/close valve provided on a branch line, the branch line being branched off from the supply/discharge line and connected to the pressure chamber; and an open/close control valve configured to control an opened/closed state of the open/close valve in accordance with presence or absence of supply of an open/close signal pressure to the open/close control valve. While the vibration suppression control circuit is in the vibration suppression control OFF state, the signal pressure supply control valve stops supplying the first signal pressure, the pressure-regulating valve is positioned in a first position in which the supply/discharge port is connected to the pump port, such that the pressure is accumulated in the pressure accumulator, and the open/close signal pressure is not supplied to the open/close control valve, such that the open/close valve is closed. When the vibration suppression control circuit switches from the vibration suppression control OFF state to the vibration suppression control ON state, the signal pressure supply control valve allows supplying the first signal pressure, and the pressure-regulating valve is brought into a second position in which the supply/discharge port is connected to the tank port, such that the pressure of the pressure accumulator decreases. While the vibration suppression control circuit is in the vibration suppression control ON state, when the pressure of the pressure accumulator has become equal to the pressure of the pressure chamber, the pressure-regulating valve is brought into a third position in which the supply/discharge port is blocked, and the open/close signal pressure is supplied to the open/close control valve, such that the open/close valve is opened.

According to the above configuration, while the vibration suppression control circuit is in the vibration suppression control OFF state, since the open/close valve is closed, the pressure accumulator is blocked from the pressure chamber. The pressure accumulator communicates with the pump port, and the pressure of the pressure accumulator increases. When the work machine starts running, the vibration suppression control circuit switches from the vibration suppression control OFF state to the vibration suppression control ON state. When the switching to the vibration suppression control ON state is made, first, the pressure of the pressure accumulator is led to the first signal chamber of the pressure-regulating valve. Immediately after the first signal pressure starts to be led to the first signal chamber, the pressure of the pressure accumulator (the first signal pressure) may be higher than the pressure of the pressure chamber (the second signal pressure). The pressure accumulator communicates with the tank port. Accordingly, the pressure of the pressure accumulator decreases. When the pressure of the pressure accumulator (the first signal pressure) has decreased to be equal to the pressure of the pressure chamber (the second signal pressure), the supply/discharge port connected to the pressure accumulator and the pressure chamber is blocked, and then the open/close valve is opened to bring the pressure accumulator into communication with the pressure chamber. Accordingly, pressure pulsation of the pressure chamber can be absorbed by the pressure accumulator. In this manner, vibration of the work apparatus can be suppressed, and consequently, vibration of the vehicle body can be suppressed.

After the switching to the vibration suppression control ON state is made, the open/close valve remains closed until the pressure of the pressure accumulator becomes equal to the pressure of the pressure chamber. In this manner, the pressure accumulator can be prevented from communicating with the pressure chamber when the pressure of the pressure accumulator is higher than the pressure of the pressure chamber. This makes it possible to prevent a shock to the vehicle body from occurring immediately after the switching to the vibration suppression control ON state is made. When the pressure of the pressure accumulator has decreased to be equal to the pressure of the pressure chamber, the open/close signal pressure is supplied to the open/close control valve to cause the open/close control valve to open the open/close valve. Therefore, promptly after the state in which the aforementioned shock will not occur (i.e., a state where there is no difference between the pressure of the pressure accumulator and the pressure of the pressure chamber) is realized, it becomes possible to suppress vibration of the work apparatus and vibration of the vehicle body.

The vibration suppression control circuit may include an open/close signal pressure supply valve including: a supply/discharge port connected to the open/close control valve; a first signal chamber to which the pressure of the pressure accumulator is led as a first signal pressure; and a second signal chamber to which the pressure of the pressure chamber is led as a second signal pressure. While the vibration suppression control circuit is in the vibration suppression control OFF state, the open/close signal pressure supply valve may be positioned in such a valve position that the supply/discharge port is connected to a drain. While the vibration suppression control circuit is in the vibration suppression control ON state, when the first signal pressure has become lower than or equal to the second signal pressure, the open/close signal pressure supply valve may be brought into such a valve position that the open/close signal pressure is supplied to the supply/discharge port.

The above configuration makes it possible to promptly and automatically bring, by means of hydraulic pressure, the pressure accumulator into communication with the pressure chamber when the pressure of the pressure accumulator has become equal to the pressure of the pressure chamber after the switching to the vibration suppression control ON state is made.

The pressure-regulating valve may be configured as an integrated valve that includes an open/close supply/discharge port connected to the open/close control valve. While the vibration suppression control circuit is in the vibration suppression control OFF state, the integrated valve may be positioned in the first position, such that the open/close supply/discharge port is connected to a drain. When the vibration suppression control circuit switches from the vibration suppression control OFF state to the vibration suppression control ON state, the integrated valve may be brought into the second position, such that the open/close supply/discharge port is connected to the drain. While the vibration suppression control circuit is in the vibration suppression control ON state, when the pressure of the pressure accumulator has become equal to the pressure of the pressure chamber, the integrated valve may be brought into the third position, such that the open/close signal pressure is supplied to the open/close supply/discharge port.

The above configuration allows the pressure-regulating valve to additionally have the function of automatically supplying the open/close signal pressure by means of hydraulic pressure. As a result, the signal pressure supply line is simplified, and thereby the configuration of the vibration suppression control circuit is made compact.

Advantageous Effects of Invention

The present invention makes it possible to provide a vibration suppression control circuit that is intended for a work vehicle and that can be simplified in configuration.

DESCRIPTION OF EMBODIMENTS

Figure 1:
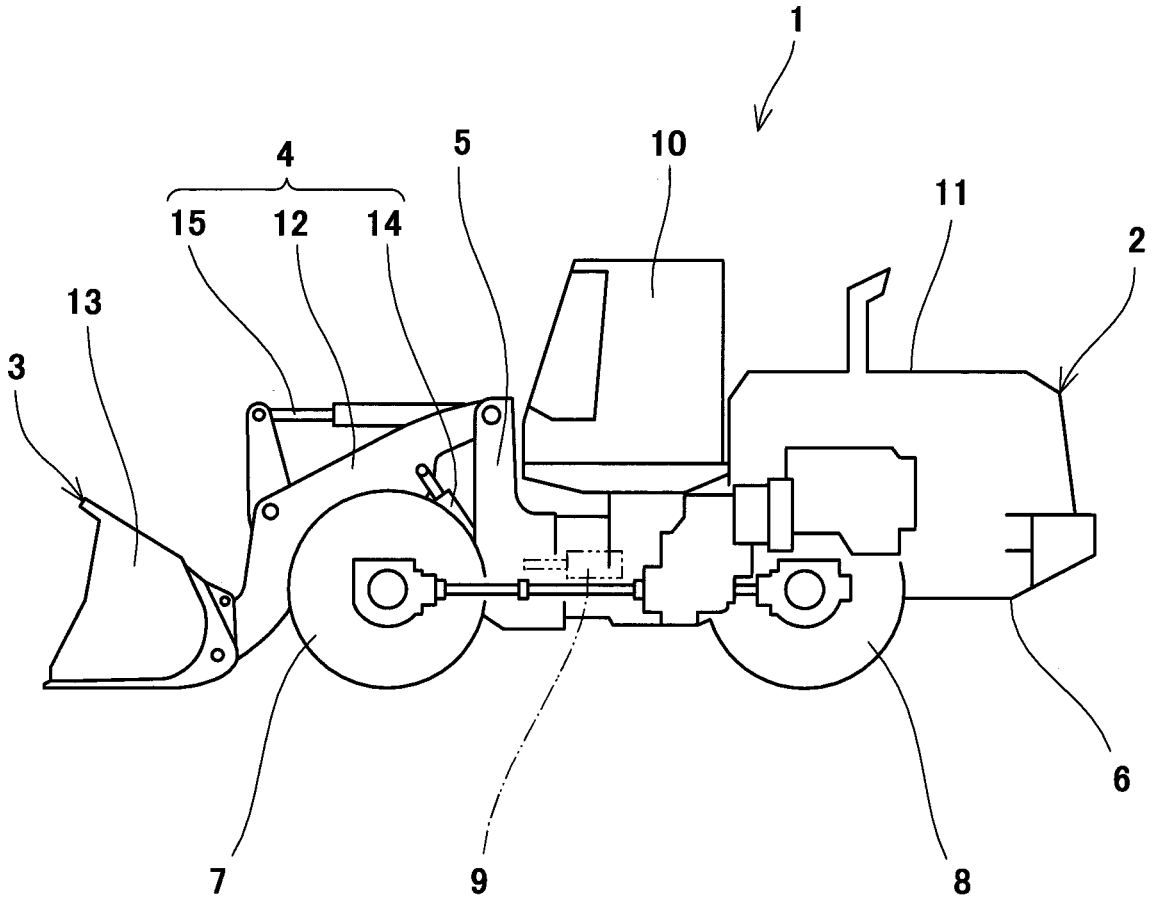
FIG. 1 is a side view of a wheel loader illustrated as one example of a work vehicle in which a vibration suppression control circuit is installed.

Hereinafter, embodiments are described with reference to the drawings. In the drawings, the same or corresponding elements are denoted by the same reference signs, and repeating the same descriptions is avoided below. Directions mentioned in the description below are directions from the perspective of an operator of a work vehicle.

FIG. 1 shows a work vehicle 1. The work vehicle 1 is a wheel loader, which is one of the wheel-driven industrial vehicles. However, the present invention is also applicable to other work vehicles, such as a shovel loader, a forklift, and a truck crane. The work vehicle 1 includes a vehicle body 2, a work apparatus 3, and an actuator 4.

The vehicle body 2 is constituted by a front vehicle body 5 and a rear vehicle body 6, which are coupled to each other so as to be swingable relative to each other in the horizontal direction. Right and left front wheels 7 are mounted to the front vehicle body 5, and right and left rear wheels 8 are mounted to the rear vehicle body 6. A pair of right and left steering cylinders 9 is provided between the front vehicle body 5 and the rear vehicle body 6. The traveling direction of the work vehicle 1 is changed in accordance with extension/retraction of the steering cylinders 9. The rear vehicle body 6 includes an operator's cab 10 and an engine room 11. An operator in the operator's cab 10 operates an unshown operating unit to operate the work apparatus 3 and to run the work vehicle 1 (e.g., run the vehicle forward/rearward, accelerate/decelerate the vehicle, and turn the vehicle).

The work apparatus 3 is operably mounted to the vehicle body 2. As one example, the work apparatus 3 includes: a boom 12 coupled to the front vehicle body 5, such that the boom 12 is swingable in the vertical direction; and a bucket 13 coupled to the distal end of the boom 12, such that the bucket 13 is swingable in the vertical direction. The actuator 4 moves the work apparatus 3 in accordance with the supply and discharge of pressure oil to and from the actuator 4. As one example, the actuator 4 includes: a pair of right and left boom cylinders 14 configured to move the boom 12; and a pair of right and left bucket cylinders 15 configured to move the bucket 13.

Embodiment 1

Figure 2:
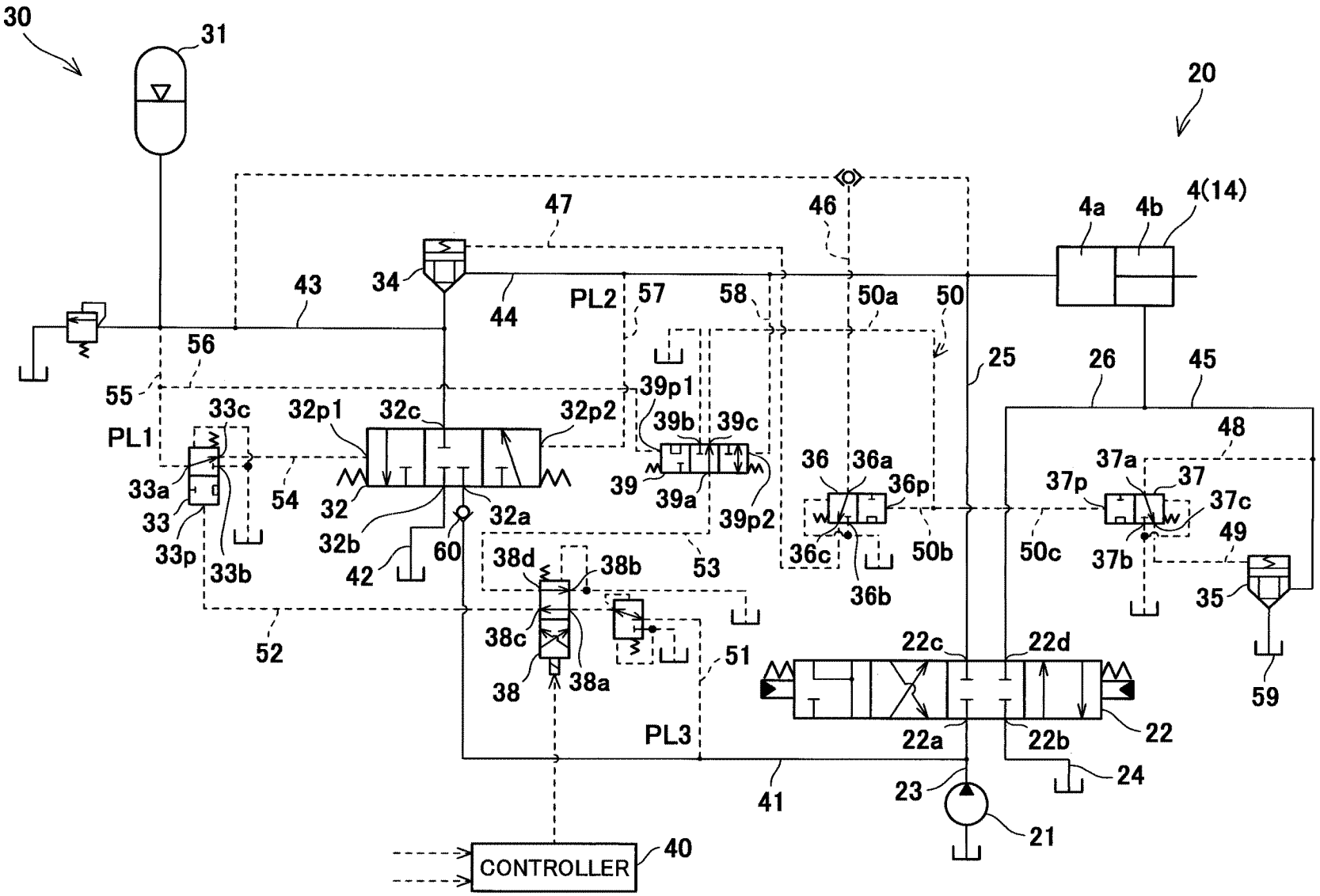
FIG. 2 shows the configuration of the vibration suppression control circuit according to Embodiment 1.

FIG. 2 shows the configuration of a hydraulic system 20 installed in the work vehicle 1 shown in FIG. 1. The hydraulic system 20 includes a pump 21 and a control valve 22. The control valve 22 moves in accordance with the aforementioned operations performed with the operating unit (not shown), thereby controlling the supply and discharge of the hydraulic fluid to and from the actuator 4. In the present embodiment, a boom cylinder 14 is illustratively described as the actuator 4. However, as an alternative, the actuator 4 may be a different type of hydraulic cylinder, or may be a hydraulic motor. As one example, the boom cylinder 14 is a double-acting single-rod cylinder including two pressure chambers that are a head-side fluid chamber 4*a* and a rod-side fluid chamber 4*b*.

The control valve 22 includes a pump port 22*a*, a tank port 22*b*, and a pair of main supply/discharge ports 22*c* and 22*d*. The pump port 22*a* is connected to the pump 21 via a supply line 23. The tank port 22*b* is connected to a tank via a discharge line 24. The main supply/discharge port 22*c* is connected to the head-side fluid chamber 4*a* via a head supply/discharge line 25. The main supply/discharge port 22*d* is connected to the rod-side fluid chamber 4*b* via a rod supply/discharge line 26.

The hydraulic system 20 includes a vibration suppression control circuit 30 (or a vibration suppression control system) according to Embodiment 1. The vibration suppression control circuit 30 includes a pressure accumulator 31, a pressure-regulating valve 32, a signal pressure supply control valve 33, open/close valves 34 and 35, open/close control valves 36 and 37, a mode switching valve 38, an open/close signal pressure supply valve 39, and a check valve 60. The mode switching valve 38 is a solenoid valve controlled by a controller 40.

The controller 40 includes, for example, a processor, a volatile memory, a nonvolatile memory, and an I/O interface. The controller 40 includes a receiving unit, a storage unit, and an output unit. The receiving unit and the output unit are realized by the I/O interface. The storage unit is realized by the volatile memory and the nonvolatile memory. Switching between magnetization and demagnetization of the mode switching valve 38 is realized as a result of the processor of the controller 40 performing arithmetic processing using the volatile memory based on a program stored in the nonvolatile memory.

The pressure-regulating valve 32 includes a pump port 32*a*, a tank port 32*b*, a supply/discharge port 32*c*, a first signal chamber 32*p*1, and a second signal chamber 32*p*2. The pressure-regulating valve 32 is a spool type direction switching valve configured to move in accordance with a pressure difference between a first signal pressure PL1 led to the first signal chamber 32*p*1 and a second signal pressure PL2 led to the second signal chamber 32*p*2. The pump port 32*a* is connected to a branch supply line 41, which is branched off from the supply line 23. The check valve 60 is interposed in the branch supply line 41. The tank port 32*b* is connected to the tank via a discharge line 42. The supply/discharge port 32*c* is connected to the pressure accumulator 31 via a supply/discharge line 43.

A branch line 44 is branched off from the supply/discharge line 43, and merges with the aforementioned head supply/discharge line 25. The branch line 44 is connected to the head-side fluid chamber 4*a* via the head supply/discharge line 25. The first open/close valve 34 is provided on the branch line 44. The second open/close valve 35 is provided on a branch discharge line 45, which is branched off from the aforementioned rod supply/discharge line 26 and is connected to the tank 59.

As one example, each of the first open/close valve 34 and the second open/close valve 35 is configured as a poppet. The poppet opens or closes in accordance with the presence or absence of the supply of pressure oil to its poppet upper fluid chamber. The first open/close valve 34 closes as a result of the pressure oil being supplied to its poppet upper fluid chamber. The second open/close valve 35 also closes as a result of the pressure oil being supplied to its poppet upper fluid chamber. However, there is a case where, even while the pressure oil is being supplied to the poppet upper fluid chamber, the pressure upstream of the poppet is higher than the pressure of the poppet upper fluid chamber. In this case, the second open/close valve 35 opens. As a result, cavitation at the cylinder rod side can be prevented. The poppet lower fluid chamber of the first open/close valve 34 is interposed in the branch line 44. The poppet lower fluid chamber of the second open/close valve 35 is interposed in the branch discharge line 45.

The open/close control valves 36 and 37 control the opened/closed state of the open/close valves 34 and 35 in accordance with the presence or absence of the supply of an open/close signal pressure PL3 to the open/close control valves 36 and 37. The first open/close control valve 36 corresponds to the first open/close valve 34, and the second open/close control valve 37 corresponds to the second open/close valve 35.

As one example, each of the first open/close control valve 36 and the second open/close control valve 37 is a pilot type/spring offset type two-position three-port direction switching valve. The first open/close control valve 36 includes an inlet port 36*a*, a drain port 36*b*, a supply/discharge port 36*c*, and a signal chamber 36*p*. The inlet port 36*a* is connected to a valve-closing pressure oil line 46, through which pressure oil necessary for closing the first open/close valve 34 flows. As shown in the circuit diagram, the hydraulic fluid whose pressure is a higher one of the pressure of the pressure accumulator 31 and the pressure of the head-side fluid chamber 4*a* is supplied to the inlet port 36*a* via the valve-closing pressure oil line 46. The supply/discharge port 36*c* is connected to the poppet upper fluid chamber of the first open/close valve 34 via a pressure oil supply/discharge line 47.

The second open/close control valve 37 also includes an inlet port 37*a*, a drain port 37*b*, a supply/discharge port 37*c*, and a signal chamber 37*p*. The inlet port 37*a* is connected to a valve-closing pressure oil line 48, through which pressure oil necessary for closing the second open/close valve 35 flows. The valve-closing pressure oil line 48 is branched off from the branch discharge line 45 at a position upstream of the second open/close valve 35, and is connected to the inlet port 37*a*. The supply/discharge port 37*c* is connected to the poppet upper fluid chamber of the second open/close valve 35 via a pressure oil supply/discharge line 49.

The drain ports 36*b* and 37*b* are connected to a drain. The signal chambers 36*p* and 37*p* are connected to a signal pressure supply line 50 for supplying the open/close signal pressure PL3. The signal pressure supply line 50 is constituted by: a shared line 50*a*; a first branch line 50*b* branched off from the shared line 50*a* and connected to the signal chamber 36*p*; and a second branch line 50*c* branched off from the shared line 50*a* and connected to the signal chamber 37*p*.

The mode switching valve 38 includes an inlet port 38*a*, a drain port 38*b*, and a pair of supply/discharge ports 38*c* and 38*d*. As one example, the mode switching valve 38 is a solenoid type/offset spring type two-position four-port direction switching valve. The signal pressure supply control valve 33 includes an inlet port 33*a*, a drain port 33*b*, a supply/discharge port 33*c*, and a signal chamber 33*p*. As one example, the signal pressure supply control valve 33 is a pilot type/offset spring type two-position three-port direction switching valve. The open/close signal pressure supply valve 39 includes an inlet port 39*a*, a drain port 39*b*, a supply/discharge port 39*c*, a first signal chamber 39*p*1, and a second signal chamber 39*p*2. Similar to the pressure-regulating valve 32, the open/close signal pressure supply valve 39 is also a spool type direction switching valve configured to move in accordance with a pressure difference between the first signal pressure PL1 led to the first signal chamber 39*p*1 and the second signal pressure PL2 led to the second signal chamber 39*p*2.

The inlet port 38*a* of the mode switching valve 38 is connected to a signal pressure line 51, which is branched off from the branch supply line 41. The supply/discharge port 38*c* is connected to the signal chamber 33*p* of the signal pressure supply control valve 33 via a signal pressure supply/discharge line 52. The supply/discharge port 38*d* is connected to the inlet port 39*a* of the open/close signal pressure supply valve 39 via a signal pressure supply/discharge line 53. The supply/discharge port 39*c* of the open/close signal pressure supply valve 39 is connected to the shared line 50*a* of the signal pressure supply line 50.

The first signal chamber 32*p*1 of the pressure-regulating valve 32 is connected to the supply/discharge port 33*c* of the signal pressure supply control valve 33 via a supply/discharge line 54. The inlet port 33*a* of the signal pressure supply control valve 33 is connected to a first signal pressure supply line 55, which is branched off from the supply/discharge line 43. The first signal chamber 39*p*1 of the open/close signal pressure supply valve 39 is also connected to a first signal pressure supply line 56, which is branched off from the supply/discharge line 43. The second signal chamber 32*p*2 of the pressure-regulating valve 32 is connected to a second signal pressure supply line 57, which is branched off from the branch line 44. The second signal chamber 39*p*2 of the open/close signal pressure supply valve 39 is also connected to a second signal pressure supply line 58, which is branched off from the branch line 44. Each of the second signal pressure supply lines 57 and 58 is branched off from the branch line 44 at a position that is closer to the actuator 4 than the first open/close valve 34 is. The pressure of the pressure accumulator 31 is led as the first signal pressure PL1 to both the first signal chamber 32*p*1 of the pressure-regulating valve 32 and the first signal chamber 39*p*1 of the open/close signal pressure supply valve 39. However, for the pressure-regulating valve 32, whether or not to allow supplying the first signal pressure PL1 thereto is controlled in accordance with the function of the signal pressure supply control valve 33. The pressure of the head-side fluid chamber 4*a* is led as the second signal pressure PL2 to both the second signal chamber 32*p*2 of the pressure-regulating valve 32 and the second signal chamber 39*p*2 of the open/close signal pressure supply valve 39.

Operations and functions of the vibration suppression control circuit 30 configured as above are described hereinafter with reference to the circuit diagram of FIG. 2 and a timing diagram of FIG. 3.

Based on information indicating the state of the work vehicle 1, which is detected by an in-vehicle sensor, the controller 40 determines whether or not the work vehicle 1 is running. As one example, the controller 40 determines whether or not the vehicle speed (moving speed of the vehicle body) of the work vehicle 1, the vehicle speed being detected by an unshown vehicle speed sensor, is higher than or equal to a mode switching threshold (e.g., 5 to 10 km/h). If the vehicle speed is higher than or equal to the mode switching threshold, the controller 40 determines that the work vehicle 1 is running. Whether or not the work vehicle 1 is running may be determined by using a different determination criterion. It should be noted that while the work vehicle 1 is running normally, the operator does not operate the work apparatus 3. During the time, the control valve 22 is positioned in such a valve position (see the second function from the right in FIG. 2) that the ports 22*a* to 22*d* are blocked.

If it is determined that the work vehicle 1 is not running, the controller 40 demagnetizes the mode switching valve 38. As a result, the vibration suppression control circuit 30 is brought into a vibration suppression control OFF state. On the other hand, if it is determined that the work vehicle 1 is running, the controller 40 magnetizes the mode switching valve 38. As a result, the vibration suppression control circuit 30 is brought into a vibration suppression control ON state. Thus, the vibration suppression control circuit 30 is configured to be switchable between the vibration suppression control ON state and the vibration suppression control OFF state while the work vehicle is running.

While the vibration suppression control circuit 30 is in the vibration suppression control OFF state, the mode switching valve 38 is positioned in such a valve position (see the upper function in FIG. 2) that the inlet port 38*a* is connected to the supply/discharge port 38*c* and the supply/discharge port 38*d* is connected to the drain port 38*b*. Accordingly, the signal pressure PL3 is supplied to the signal chamber 33*p* of the signal pressure supply control valve 33. As a result, at the signal pressure supply control valve 33, the inlet port 33*a* is blocked and the supply/discharge port 33*c* is connected to the drain port 33*b* (see the lower function in FIG. 2). Consequently, at the pressure-regulating valve 32, the pressure of the second signal chamber 32*p*2 (i.e., the pressure of the head-side fluid chamber 4*a*) exceeds the pressure of the first signal chamber 32*p*1 (i.e., drain pressure). The pressure-regulating valve 32 is positioned in a first position (see the right function in FIG. 2) in which the pump port 32*a* is connected to the supply/discharge port 32*c*. Accordingly, the pressure of the pressure accumulator 31 is increased by pressure oil that flows through the supply/discharge line 43. It should be noted that, as described below, the first open/close valve 34 is in a valve-closed state, and the pressure accumulator 31 is blocked from the head-side fluid chamber 4*a*.

At the open/close signal pressure supply valve 39, the pressure of the first signal chamber 39*p*1 (i.e., the pressure of the pressure accumulator 31) exceeds the pressure of the second signal chamber 39*p*2 (i.e., the pressure of the head-side fluid chamber 4*a*). The open/close signal pressure supply valve 39 is positioned in a first position (see the left function in FIG. 2) in which the inlet port 39*a* is blocked and the supply/discharge port 39*c* is connected to the drain port 39*b*. Accordingly, both at the first open/close control valve 36 and the second open/close control valve 37, the signal chambers 36*p* and 37*p* are connected to the drain. Both the first open/close control valve 36 and the second open/close control valve 37 are positioned in respective valve-closed positions (see the left function in FIG. 2 for the valve 36 and the right function in FIG. 2 for the valve 37) in which the inlet ports 36*a* and 37*a* are connected to the supply/discharge ports 36*c* and 37*c*, respectively. Both at the first open/close valve 34 and the second open/close valve 35, pressure oil for closing the valve is led to the poppet upper fluid chamber. Accordingly, both the first open/close valve 34 and the second open/close valve 35 are in a valve-closed state. It should be noted that even if the second signal pressure PL2 becomes higher than or equal to the first signal pressure PL1 and the open/close signal pressure supply valve 39 is brought into a position different from the first position, the signal pressure PL3 is not supplied to the inlet port 39*a*, i.e., not supplied to the open/close control valves 36 and 37. Accordingly, the open/close valves 34 and 35 are kept in a valve-closed state.

When the vibration suppression control circuit 30 switches from the vibration suppression control OFF state to the vibration suppression control ON state (see time t1 in FIG. 3), the mode switching valve 38 is magnetized. After the vibration suppression control circuit 30 has switched to the vibration suppression control ON state, the vibration suppression effect is actually exerted only when the head-side fluid chamber 4*a* has been brought into communication with the pressure accumulator 31. In the description below, a state after the vibration suppression control circuit 30 has switched to the vibration suppression control ON state and before the head-side fluid chamber 4*a* is brought into communication with the pressure accumulator 31 is referred to as "standby state", and a state where the head-side fluid chamber 4*a* is in communication with the pressure accumulator 31 is referred to as "communicating state".

When the vibration suppression control circuit 30 switches from the vibration suppression control OFF state to the vibration suppression control ON state (standby state), the mode switching valve 38 is brought into such a valve position (see the lower function in FIG. 2) that the inlet port 38*a* is connected to the supply/discharge port 38*d* and the supply/discharge port 38*c* is connected to the drain port 38*b*. The signal chamber 33*p* of the signal pressure supply control valve 33 is connected to the drain, and at the signal pressure supply control valve 33, the inlet port 33*a* is connected to the supply/discharge port 33*c* (see the upper function in FIG. 2). Accordingly, the pressure of the pressure accumulator 31 is led as the first signal pressure PL1 to the first signal chamber 32*p*1 of the pressure-regulating valve 32. While the vibration suppression control circuit 30 is in the vibration suppression control OFF state, the pressure of the pressure accumulator 31 is kept high. Accordingly, the first signal pressure PL1 (i.e., the pressure of the pressure accumulator 31) exceeds the second signal pressure PL2 (i.e., the pressure of the head-side fluid chamber 4*a*). The pressure-regulating valve 32 is brought into a second position (see the left function in FIG. 2) in which the pump port 32*a* is blocked and the supply/discharge port 32*c* is connected to the tank port 32*b*. Accordingly, the pressure accumulator 31 is connected to the tank, and the pressure of the pressure accumulator 31 decreases.

As a result of the mode switching valve 38 switching its valve position, the open/close signal pressure PL3 is supplied to the inlet port 39*a* of the open/close signal pressure supply valve 39. However, since the first signal pressure PL1 is higher than the second signal pressure PL2, the open/close signal pressure supply valve 39 remains in the aforementioned first position (see the left function in FIG. 2). For this reason, the open/close signal pressure PL3 is not supplied to the signal pressure supply line 50, and the first open/close valve 34 is kept in a valve-closed state continuously from the vibration suppression control OFF state. In this manner, the standby state is realized. Even when the mode switching valve 38 changes its valve position, the open/close signal pressure PL3 is not supplied to the signal chamber 37*p*. Accordingly, the second open/close control valve 37 is kept in a valve-closed position.

Figure 3:
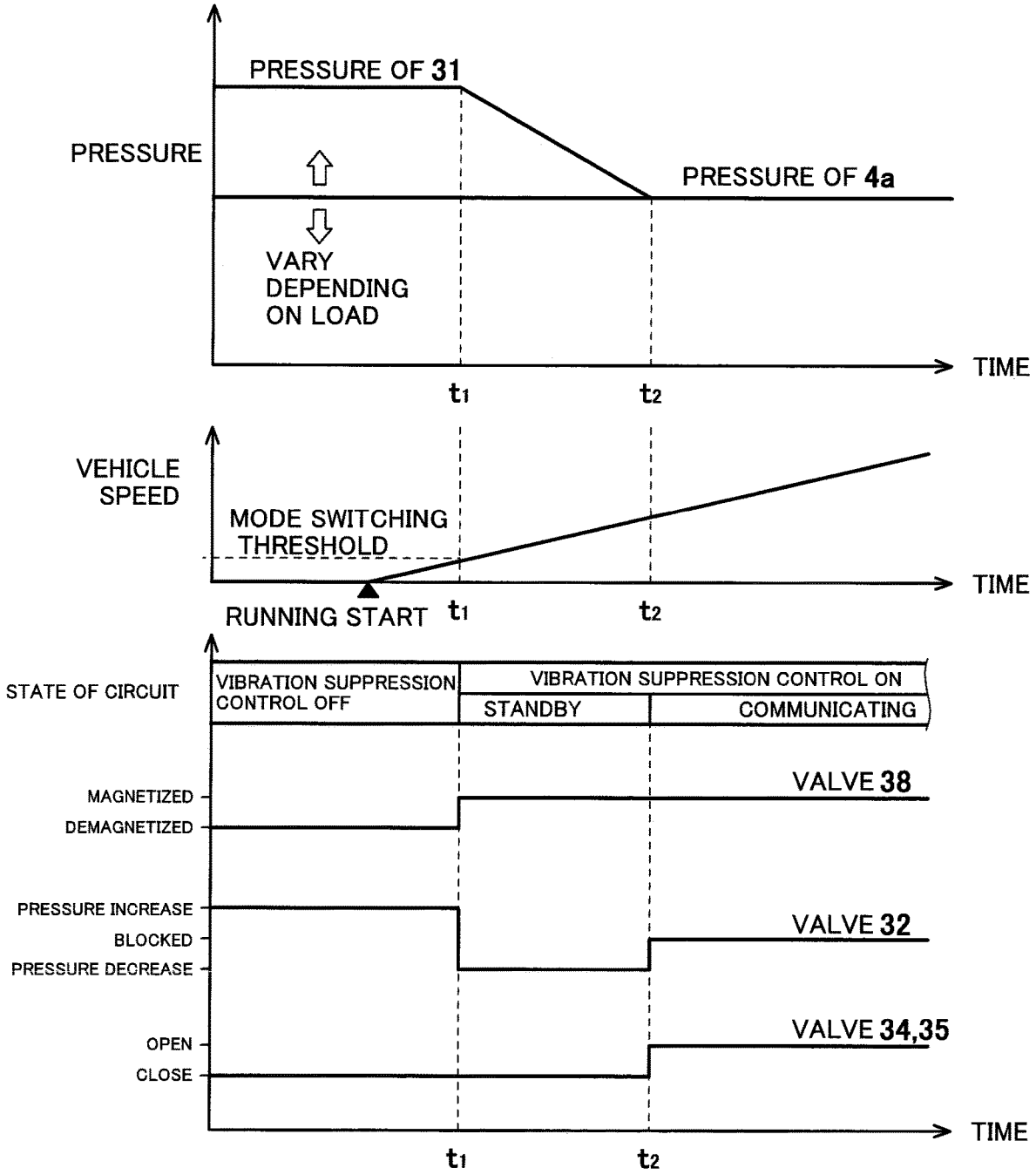
FIG. 3 is a timing diagram illustrating the functions of the vibration suppression control circuit.

When the pressure of the pressure accumulator 31 has decreased to be equal to the pressure of the head-side fluid chamber 4*a*, the standby state ends (see time t2 in FIG. 3).

Both at the pressure-regulating valve 32 and at the open/close signal pressure supply valve 39, the first signal pressure PL1 (i.e., the pressure of the pressure accumulator 31) becomes equal to the second signal pressure PL2 (i.e., the pressure of the head-side fluid chamber 4*a*). The pressure-regulating valve 32 is brought into a third position (see the center function in FIG. 2) in which the pump port 32*a* and the supply/discharge port 32*c* are blocked. The open/close signal pressure supply valve 39 is brought into a second position (see the center function in FIG. 2) in which the inlet port 39*a* is connected to the supply/discharge port 39*c*. Accordingly, the open/close signal pressure PL3 is led to the signal chamber 36*p* of the first open/close control valve 36 and the signal chamber 37*p* of the second open/close control valve 37.

Both the first open/close control valve 36 and the second open/close control valve 37 are brought into respective valve-open positions (see the right function in FIG. 2 for the valve 36 and the left function in FIG. 2 for the valve 37) in which the inlet ports 36*a* and 37*a* are blocked and the supply/discharge ports 36*c* and 37*c* are connected to the drain ports 36*b* and 37*b*, respectively. The poppet upper fluid chamber of each of the first open/close valve 34 and the second open/close valve 35 is connected to the drain, and both the first open/close valve 34 and the second open/close valve 35 are brought into a valve-open state. Accordingly, the head-side fluid chamber 4*a* is brought into communication with the pressure accumulator 31, i.e., the state shifts from the standby state to the communicating state. In the communicating state, the rod-side fluid chamber 4*b* is connected to the tank.

In the communicating state, pressure pulsation of the head-side fluid chamber 4*a* is absorbed by the pressure accumulator 31. As a result, even when external force from a road surface or the like is applied to the work vehicle 1 while it is running, undesirable movement of the actuator 4 can be suppressed. Since vibration of the work apparatus 3 can be suppressed, vibration of the vehicle body 2 and vibration of the operator's cab 10 thereof can be suppressed, accordingly. This makes it possible to improve the comfortableness of the ride while the work vehicle 1 is running.

As described above, in the vibration suppression control circuit according to the present embodiment, when the vibration suppression control circuit switches from the vibration suppression control OFF state to the vibration suppression control ON state, the pressure accumulator 31 is not immediately brought into communication with the head-side fluid chamber 4*a*, but remains in the state in which the pressure accumulator 31 is blocked from the head-side fluid chamber 4*a* until the pressure of the pressure accumulator 31 becomes equal to the pressure of the head-side fluid chamber 4*a*. If the pressure accumulator 31 is brought into communication with the head-side fluid chamber 4*a* when there is a pressure difference between the pressure of the pressure accumulator 31 and the pressure of the head-side fluid chamber 4*a*, it is possible that a shock occurs to the vehicle body 2. According to the present embodiment, such a shock can be prevented from occurring, which makes it possible to improve the comfortableness of the ride.

Then, when the pressure of the pressure accumulator 31 has decreased to be equal to the pressure of the head-side fluid chamber 4*a* (i.e., when a state in which the communication of the pressure accumulator 31 with the head-side fluid chamber 4*a* does not cause the aforementioned shock is realized), the open/close valves 34 and 35 are opened promptly, and the shift from the standby state to the communicating state is made. Therefore, promptly after the aforementioned state is realized, in which the communication of the pressure accumulator 31 with the head-side fluid chamber 4*a* does not cause the shock, the vibration suppression control circuit 30 can actually exert the vibration suppression effect, and thereby the comfortableness of the ride can be improved.

The shifting from the standby state to the communicating state utilizes not electromagnetic means but hydraulic pressure, and the vibration suppression control circuit 30 includes necessary components for performing the shifting by means of hydraulic pressure. The state shifting is realized without using such devices as pressure sensors, without requiring the construction of a control routine that refers to results of detection by the pressure sensors, and without requiring the implementation of such a control routine in the controller. This makes it possible to simplify both hardware and software configurations of the vibration suppression control circuit 30.

Embodiment 2

Hereinafter, a vibration suppression control circuit 130 according to Embodiment 2 is described focusing on its differences from Embodiment 1. In Embodiment 1 described above, the pressure-regulating valve 32 and the open/close signal pressure supply valve 39 are configured as spool type direction switching valves that are independent of each other; and the first signal pressure PL1, which is the pressure of the pressure accumulator 31, and the second signal pressure PL2, which is the pressure of the head-side fluid chamber 4*a*, are led to each of the valves 32 and 39 for switching their valve position. Similar to Embodiment 1, the vibration suppression control circuit 130 according to the present embodiment is included in a hydraulic system 120 installed in a work vehicle. Meanwhile, the vibration suppression control circuit 130 according to the present embodiment includes an integrated valve 160, which has both the functions of the pressure-regulating valve 32 and the functions of the open/close signal pressure supply valve 39.

Figure 4:
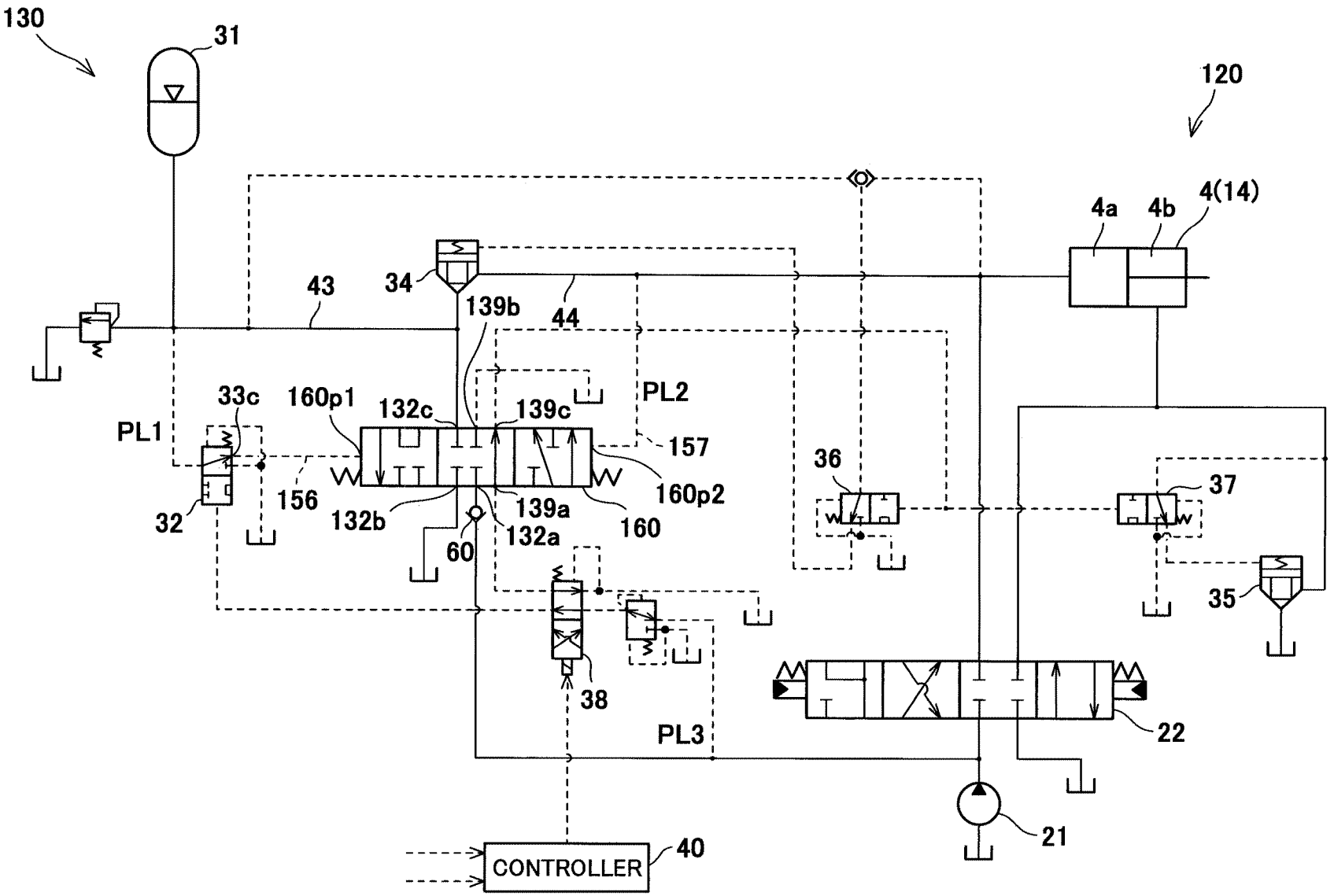
FIG. 4 shows the configuration of a vibration suppression control circuit according to Embodiment 2.

As shown in FIG. 4, the integrated valve 160 is a single-spool pilot type direction switching valve. The integrated valve 160 includes a first signal chamber 160*p*1 and a second signal chamber 160*p*2. The first signal chamber 160*p*1 is connected to the supply/discharge port 33*c* of the signal pressure supply control valve 33 via a supply/discharge line 156. The second signal chamber 160*p*2 is connected to a second signal pressure supply line 157, which is branched off from the branch line 44.

The integrated valve 160 includes a pump port 132*a*, a tank port 132*b*, a supply/discharge port 132*c*, an inlet port 139*a*, a drain port 139*b*, and a supply/discharge port 139*c*. The ports 132*a* to 132*c* correspond to the ports 32*a* to 32*c* of the pressure-regulating valve 32 according to Embodiment 1, and the ports 139*a* to 139*c* correspond to the ports 39*a* to 39*c* of the open/close signal pressure supply valve 39 according to Embodiment 1.

While the vibration suppression control circuit 130 is in the vibration suppression control OFF state, the second signal pressure PL2 (i.e., the pressure of the head-side fluid chamber 4*a*) exceeds the first signal pressure PL1 (i.e., drain pressure), and the integrated valve 160 is positioned in a first position (see the right function in FIG. 4) in which the pump port 132*a* is connected to the supply/discharge port 132*c* and the supply/discharge port 139*c* is connected to the inlet port 139*a*. Accordingly, the pressure is accumulated in the pressure accumulator 31. The supply/discharge port 139*c* is connected to the drain via the inlet port 139*a* of the integrated valve 160 and the mode switching valve 38. The open/close signal pressure PL3 is not supplied to the open/close control valves 36 and 37, such that the open/close valves 34 and 35 are in a valve-closed state.

When the vibration suppression control circuit 130 switches from the vibration suppression control OFF state to the vibration suppression control ON state (standby state), the pressure of the pressure accumulator 31 is led as the first signal pressure PL1 to the first signal chamber 160*p*1 of the integrated valve 160. The first signal pressure PL1 (i.e., the pressure of the pressure accumulator) exceeds the second signal pressure PL2 (i.e., the pressure of the head-side fluid chamber 4*a*), and the integrated valve 160 is brought into a second position (see the left function in FIG. 4) in which the supply/discharge port 132*c* is connected to the tank port 132*b* and the supply/discharge port 139*c* is connected to the drain port 139*b*. While the pressure of the pressure accumulator 31 is decreasing, the open/close valves 34 and 35 are kept in a valve-closed state. In this manner, the standby state is realized.

When the pressure of the pressure accumulator 31 has decreased to be equal to the pressure of the head-side fluid chamber 4*a*, the standby state ends and shifts to the communicating state. That is, the first signal pressure PL1 (i.e., the pressure of the pressure accumulator 31) becomes equal to the second signal pressure PL2 (i.e., the pressure of the head-side fluid chamber 4*a*), and the integrated valve 160 is brought into a third position (see the center function in FIG. 4) in which the supply/discharge port 132*c* and the pump port 132*a* are blocked and the inlet port 139*a* is connected to the supply/discharge port 139*c*. The open/close signal pressure PL3 is supplied to the open/close control valves 36 and 37, such that the open/close valves 34 and 35 are brought into a valve-open state. Accordingly, the pressure accumulator 31 is brought into communication with the head-side fluid chamber 4*a*, and the rod-side fluid chamber 4*b* is connected to the tank.

The present embodiment provides the same functional advantages as those of Embodiment 1. Further, in the present embodiment, the functions of the pressure-regulating valve 32 and the functions of the open/close signal pressure supply valve 39 are integrated in the integrated valve 160. As a result, the lines for supplying the first signal pressure PL1 and the second signal pressure PL2 are simplified, and the number of valves is reduced. Consequently, the configuration of the vibration suppression control circuit 130 is made compact.

Although the embodiments have been described as above, suitable modifications, deletions, and additions can be made to the above-described configurations within the scope of the present invention.

For example, the signal pressure supply control valve 33 may be a solenoid valve. In this case, the signal chamber 33*p* of the signal pressure supply control valve 33, and the line that connects one of the ports of the mode switching valve 38 to the signal pressure supply control valve 33, may be eliminated, and the mode switching valve 38 may be used as a valve dedicated to supply and discharge a signal pressure to and from the open/close signal pressure supply valve 39.

REFERENCE SIGNS LIST work vehicle
vehicle body
work apparatus
actuator
4*a* head-side fluid chamber (pressure chamber)
4*b* rod-side fluid chamber (pressure chamber)
30, 130 vibration suppression control circuit
pressure accumulator
pressure-regulating valve
32*a* pump port
32*b* tank port
32*c* supply/discharge port
32*p*1 first signal chamber
32*p*2 second signal chamber
33 signal pressure supply control valve
34, 35 open/close valve
36, 37 open/close control valve
supply/discharge line
branch line
160 integrated valve
PL1 first signal pressure
PL2 second signal pressure
PL3 open/close signal pressure

The invention claimed is:

1. A vibration suppression control circuit installed in a work machine, the work machine including an actuator configured to move a work apparatus mounted to a vehicle body of the work machine in accordance with supply and discharge of pressure oil to and from a pressure chamber of the actuator, the vibration suppression control circuit being switchable between a vibration suppression control OFF state and a vibration suppression control ON state while the work machine is running, the vibration suppression control circuit comprising:

a pressure accumulator;

a pressure-regulating valve including:

a supply/discharge port connected to the pressure accumulator via a supply/discharge line, a pump port, a tank port, a first signal chamber to which a pressure of the pressure accumulator is transferred as a first signal pressure, and a second signal chamber to which a pressure of the pressure chamber is transferred as a second signal pressure;

a signal pressure supply control valve configured to control whether to allow supplying the first signal pressure to the first signal chamber;

an open/close valve provided on a branch line, the branch line being branched off from the supply/discharge line and connected to the pressure chamber;

an open/close control valve configured to control an opened/closed state of the open/close valve in accordance with a presence or an absence of supply of an open/close signal pressure to the open/close control valve; and an open/close signal pressure supply valve including:

a supply/discharge port connected to the open/close control valve, a first signal chamber to which the pressure of the pressure accumulator is transferred as a first signal pressure, and a second signal chamber to which the pressure of the pressure chamber is transferred as a second signal pressure, wherein:

while the vibration suppression control circuit is in the vibration suppression control OFF state, the signal pressure supply control valve stops supplying the first signal pressure, the pressure-regulating valve is positioned in a first position in which the supply/discharge port is connected to the pump port, such that the pressure is accumulated in the pressure accumulator, and the open/close signal pressure is not supplied to the open/close control valve, such that the open/close valve is closed, when the vibration suppression control circuit switches from the vibration suppression control OFF state to the vibration suppression control ON state, the signal pressure supply control valve allows supplying the first signal pressure, and the pressure-regulating valve is switched into a second position in which the supply/discharge port is connected to the tank port, such that the pressure of the pressure accumulator decreases, and while the vibration suppression control circuit is in the vibration suppression control ON state, when the pressure of the pressure accumulator is equal to the pressure of the pressure chamber, the pressure-regulating valve is switched into a third position in which the supply/discharge port is blocked, and when the pressure of the pressure accumulator is lower than or equal to the pressure of the pressure chamber, the open/close signal pressure supply valve is switched into a valve position that the open/close signal pressure is supplied to the supply/discharge port connected to the open/close control valve, and the open/close signal pressure is supplied to the open/close control valve, such that the open/close control valve is opened.

2. The vibration suppression control circuit according to claim 1, wherein:

while the vibration suppression control circuit is in the vibration suppression control OFF state, the open/close signal pressure supply valve is positioned in a valve position that the supply/discharge port is connected to a drain.

3. A vibration suppression control circuit installed in a work machine, the work machine including an actuator configured to move a work apparatus mounted to a vehicle body of the work machine in accordance with supply and discharge of pressure oil to and from a pressure chamber of the actuator, the vibration suppression control circuit being switchable between a vibration suppression control OFF state and a vibration suppression control ON state while the work machine is running, the vibration suppression control circuit comprising:

a pressure accumulator;

a pressure-regulating valve including:

a supply/discharge port connected to the pressure accumulator via a supply/discharge line, a pump port, a tank port, a first signal chamber to which a pressure of the pressure accumulator is transferred as a first signal pressure, and a second signal chamber to which a pressure of the pressure chamber is transferred as a second signal pressure;

a signal pressure supply control valve configured to control whether to allow supplying the first signal pressure to the first signal chamber;

an open/close valve provided on a branch line, the branch line being branched off from the supply/discharge line and connected to the pressure chamber; and an open/close control valve configured to control an opened/closed state of the open/close valve in accordance with a presence or an absence of supply of an open/close signal pressure to the open/close control valve, wherein:

the pressure-regulating valve includes an open/close supply/discharge port connected to the open/close control valve, while the vibration suppression control circuit is in the vibration suppression control OFF state, the signal pressure supply control valve stops supplying the first signal pressure, the pressure-regulating valve is positioned in a first position in which the supply/discharge port is connected to the pump port, such that the pressure is accumulated in the pressure accumulator, and the open/close signal pressure is not supplied to the open/close control valve, such that the open/close valve is closed, when the vibration suppression control circuit switches from the vibration suppression control OFF state to the vibration suppression control ON state, the signal pressure supply control valve allows supplying the first signal pressure, and the pressure-regulating valve is brought into a second position in which the supply/discharge port is connected to the tank port, such that the pressure of the pressure accumulator decreases, and while the vibration suppression control circuit is in the vibration suppression control ON state, when the pressure of the pressure accumulator has become equal to the pressure of the pressure chamber, the pressure-regulating valve is brought into a third position in which the supply/discharge port is blocked, the open/close signal pressure is supplied to the open/close supply/discharge port connected to the open/close control valve, and the open/close signal pressure is supplied to the open/close control valve, such that the open/close control valve is opened.

4. The vibration suppression control circuit according to claim 3, wherein:

while the vibration suppression control circuit is in the vibration suppression control OFF state, the pressure-regulating valve is positioned in the first position, such that the open/close supply/discharge port is connected to a drain, and when the vibration suppression control circuit switches from the vibration suppression control OFF state to the vibration suppression control ON state, the pressure-regulating valve is switched into the second position, such that the open/close supply/discharge port is connected to the drain.

* * * * *